US008141351B2

(12) United States Patent
Ponnathpur et al.

(10) Patent No.: US 8,141,351 B2
(45) Date of Patent: Mar. 27, 2012

(54) PRE-CATALYST FOR PREVENTING FACE-PLUGGING ON AN INLET FACE OF AN AFTERTREATMENT DEVICE AND METHOD OF THE SAME

(75) Inventors: Chetan Ponnathpur, Columbus, IN (US); Thomas M. Yonushonis, Columbus, IN (US); Javier Franco, Columbus, IN (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 353 days.

(21) Appl. No.: 12/109,813

(22) Filed: Apr. 25, 2008

(65) Prior Publication Data

US 2009/0266062 A1 Oct. 29, 2009

(51) Int. Cl.
*F01N 3/10* (2006.01)

(52) U.S. Cl. ..... 60/299; 60/274; 60/295; 60/311; 55/522; 55/524; 422/169; 422/170; 422/171; 422/177

(58) Field of Classification Search ..... 60/285, 60/297, 302, 274, 295, 299, 311; 55/522, 55/523, 524; 422/168, 169, 170, 171, 177
See application file for complete search history.

(56) References Cited

U.S. PATENT DOCUMENTS

| | | | | |
|---|---|---|---|---|
| 5,278,125 | A * | 1/1994 | Iida et al. | 502/439 |
| 5,519,993 | A * | 5/1996 | Rao et al. | 60/288 |
| 5,525,307 | A * | 6/1996 | Yasaki et al. | 422/171 |
| 6,294,141 | B1 * | 9/2001 | Twigg et al. | 423/213.7 |
| 6,826,906 | B2 * | 12/2004 | Kakwani et al. | 60/303 |
| 7,229,597 | B2 * | 6/2007 | Patchett et al. | 422/177 |
| 7,816,295 | B2 * | 10/2010 | Liu et al. | 502/60 |
| 7,862,640 | B2 * | 1/2011 | Zhang et al. | 55/523 |
| 2002/0076372 | A1 * | 6/2002 | Leloup et al. | 422/222 |

OTHER PUBLICATIONS

Dawson et al. "Faster is Better: The Effect of Internal Turbulenee on DOC Efficiency." SAE Paper No. 2006-01-1526, SAE 2006 World Congress & Exhibition, Apr. 2006.

* cited by examiner

*Primary Examiner* — Binh Q Tran
(74) *Attorney, Agent, or Firm* — Hamre, Schumann, Mueller & Larson, P.C.

(57) ABSTRACT

A pre-catalyst device configured to be disposed upstream of a main aftertreatment device of an engine exhaust system. An oxidizing material is disposed on an inlet face of the pre-catalyst device, where the oxidizing material is configured to oxidize engine exhaust before the engine exhaust reaches the main aftertreatment device of the engine exhaust system.

25 Claims, 3 Drawing Sheets

PRE-CATALYST FOR PREVENTING FACE-PLUGGING ON AN INLET FACE OF AN AFTERTREATMENT DEVICE AND METHOD OF THE SAME

FIELD

A pre-catalyst device for an engine exhaust system is disposed upstream of a main aftertreatment device. An oxidizing material disposed on an inlet face of the pre-catalyst device oxidizes engine exhaust before it reaches the main aftertreatment device.

BACKGROUND

Aftertreatment devices are well known and widely used in various internal combustion engine applications for the aftertreatment of engine exhaust gases. Such devices as diesel oxidation catalysts and diesel particulate filters have been useful for handling and/or removing diesel exhaust materials, including carbon monoxide, nitric oxide, unburned hydrocarbons, and soot in the exhaust stream of an engine.

Although particulate filters are sometimes not catalyzed, many oxidation catalysts commonly employ a catalyzed material applied to interior surfaces within fluid passageways of a cellular structure. Undesired exhaust material(s) react with the catalyst material, thus diminishing the undesired exhaust material(s).

However, inlet face plugging (coking) of diesel oxidation catalysts and diesel particulate filters continues to be an issue for vehicles with transient or less aggressive duty cycles, during cold ambient operating conditions, and during extended idling conditions. Other conditions that may lead to inlet face plugging can include frequent start and stop operation and engine operation during relatively low exhaust temperature ranges, such as 220° C. to 400° C. Face-plugging or fouling has been known as residue, such as exhaust materials and/or soot particles that accumulate on the outer surface of the cellular and channel structure at the inlet face of an aftertreatment device, and effectively reduces the open frontal area of the aftertreatment device.

Face-plugging is problematic, because it can result in a sharp rise in backpressure in aftertreatment or exhaust systems, which in turn may affect engine operation and decrease system efficiency. For example, face plugging of the aftertreatment device prevents effective conversion of injected hydrocarbon across the aftertreatment device, resulting in ineffective particulate filter regenerations due to low temperatures. Face plugging can also result in fuel penalty as fuel is being dosed for extended amounts with no benefit to filter regeneration. Face plugging can eventually lead to filter failures due to uncontrolled thermal events during transient driving conditions. Thus, preventing the formation of the soot/coke deposits on the inlet face of the aftertreatment device under all operating conditions is desirable.

Current closed loop control strategies to clean the aftertreatment device have tracked the amount of time spent dosing fuel in the exhaust using a straight time based count down timer to predict face plugging on the device. On reaching a threshold, the engine operating mode is switched to a high $NO_x$, low particulate matter condition to oxidize any carbon deposits and clean out the aftertreatment device. However, such a method can take approximately 3 to 4 hours to clean the aftertreatment device and may not be completely effective. The reason being plugging of the flow channels usually begins from the front or inlet face at the end of the aftertreatment device. The level of $NO_2$, which is known as a primary oxidizing agent, is found in low quantities in engine out diesel exhaust and is not effective in oxidizing soot on the inlet face.

There is a need to provide an improved engine exhaust system that can prevent and/or eliminate face-plugging or fouling at the inlet face of such aftertreatment devices.

SUMMARY

The following technical disclosure describes an improved engine exhaust aftertreatment system, where a pre-catalyst device is incorporated with an engine exhaust system. The pre-catalyst device is disposed upstream of a main aftertreatment device of the engine exhaust system, and an oxidizing material is disposed on surfaces of the pre-catalyst device. The oxidizing material is configured to oxidize engine exhaust before the engine exhaust reaches the main aftertreatment device.

Generally, the pre-catalyst device oxidizes engine exhaust prior to the engine exhaust reaching a main aftertreatment device of the engine exhaust system. By providing such effect, face-plugging of an inlet face of the main aftertreatment device can be prevented or at least minimized. For example, the pre-catalyst device can oxidize or convert NO present in engine exhaust to $NO_2$, and thereby increase the effective $NO_2$ available for preventing soot/coke deposits from face-plugging the main aftertreatment device. In some instances, the particular arrangement of the pre-catalyst device may increase flow turbulence and flow distribution to facilitate prevention of face-plugging.

In one embodiment, a pre-catalyst device includes a main body having an inlet and an outlet. The main body is configured with a flow path between the inlet and outlet such that engine exhaust may flow through the inlet and outlet. A plurality of channels is disposed within the flow path. Each of the channels includes a wall structure, such that the channels are configured as multiple distinct openings at the inlet and extend through the main body to the outlet. The main body is configured to be disposed upstream of a main aftertreatment device of an engine exhaust system. An oxidizing material is disposed on surfaces of the wall structure of the plurality of channels. The oxidizing material is configured to oxidize engine exhaust before the engine exhaust reaches the main aftertreatment device.

In one embodiment, the oxidizing material is configured as a coating on an end face of the inlet of the main body. In another embodiment, the pre-catalyst device is configured to be disposed approximately 2 to 3 inches upstream of the main aftertreatment device of the engine exhaust system. In another embodiment, the pre-catalyst device is configured to be connected directly to a turbine outlet of an engine.

In yet another embodiment, an engine exhaust system includes a main aftertreatment device and is incorporated with any of the above-described pre-catalyst device(s), where a flow through configuration of the pre-catalyst device and a flow through configuration of the main aftertreatment device are arranged in an offset relationship.

In yet another embodiment, a method of preventing face-plugging on a main aftertreatment device for an engine exhaust system includes receiving engine exhaust at a pre-catalyst device. The engine exhaust is oxidized with an oxidizing material disposed on the pre-catalyst device. The oxidized engine exhaust is delivered from the pre-catalyst device downstream to a main aftertreatment device. Face-plugging of an inlet face of the main aftertreatment device is prevented by cleaning the inlet face of the main aftertreatment device with the oxidized engine exhaust flowing from the pre-catalyst device to the main aftertreatment device.

DETAILED DESCRIPTION

A pre-catalyst device for an engine exhaust aftertreatment system is described. Generally, the pre-catalyst device includes an oxidizing material coated onto a surface of the device, and the pre-catalyst device is configured to be disposed before a main aftertreatment device, such as a diesel oxidation catalyst or a diesel particulate filter. The pre-catalyst device can prevent inlet face plugging on the aftertreatment device. The pre-catalyst device provides a configuration for an engine exhaust aftertreatment system that can increase catalyst volume without increasing the size of the muffler kit, can enable higher temperature regeneration, can improve regeneration robustness, can minimize fuel consumption, and can minimize the likelihood of face plugging and enhance dosed fuel vaporization.

Figure 1:
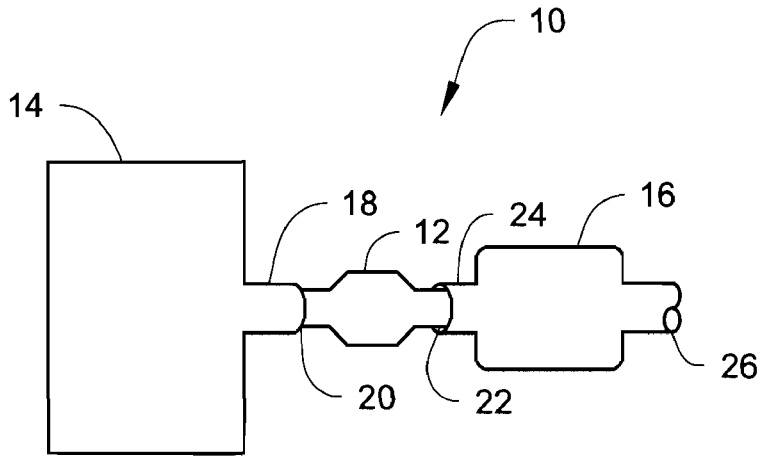
FIG. 1 is a schematic representation of one embodiment of an exhaust system including an embodiment of a pre-catalyst device.
Figure 2:
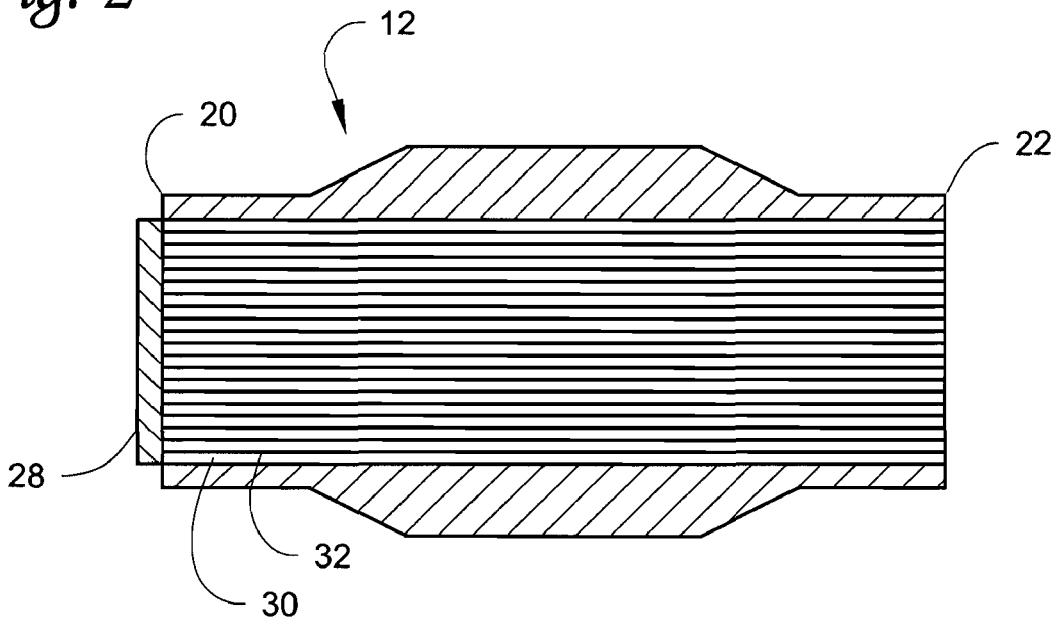
FIG. 2 is a schematic sectional representation of the pre-catalyst device shown in FIG. 1.
Figure 3:
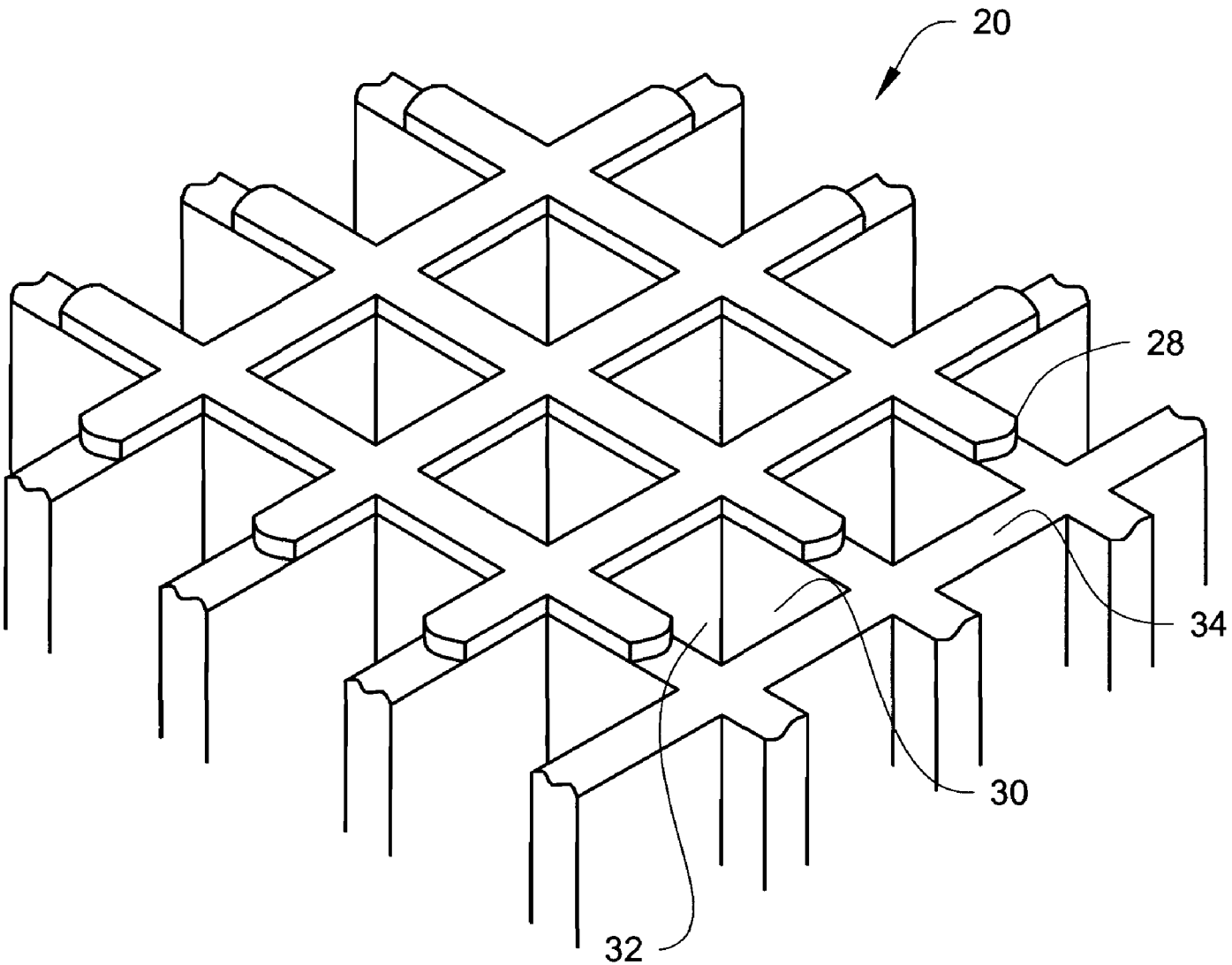
FIG. 3 is a partial perspective end view of the pre-catalyst device shown in FIG. 2.

Turning to the drawings, FIGS. 1-3 generally illustrate an improved engine exhaust aftertreatment system 10, where a pre-catalyst device 12 is incorporated with the engine exhaust aftertreatment system 10. The pre-catalyst device 12 is disposed upstream of a main aftertreatment device 16. An oxidizing material is disposed on surfaces of the pre-catalyst device 12 (best shown in FIGS. 2 and 3). Generally, the oxidizing material is configured to oxidize engine exhaust before the engine exhaust reaches the main aftertreatment device 16. By providing such an effect, face-plugging of an inlet face of the main aftertreatment device 16 can be prevented or at least minimized. For example, the pre-catalyst device can oxidize or convert NO present in engine exhaust to $NO_2$, and thereby increase the effective $NO_2$ available for preventing soot/coke from depositing and plugging the inlet face of the main aftertreatment device 16.

In one embodiment, the pre-catalyst device 12 includes a main body having an inlet 20 and an outlet 22. Each of the main body, inlet 20, and outlet 22 of the pre-catalyst device 12 is generally cylindrical in nature. The main body between the inlet 20 and outlet 22 may have a larger diameter relative to the inlet 20 and outlet. In some instances, the main body is one of a ceramic material or a metallic material. The material for constructing the pre-catalyst device may be based on cost and its application, however, the material for the pre-catalyst device desirably has a low thermal mass to reach light off temperature in a short time to effectively convert NO to $NO_2$ for availability to clean an inlet face of a main aftertreatment device.

As shown, the main body is configured with a flow through configuration having a flow path between the inlet 20 and outlet 22 such that engine exhaust may flow through the inlet 20 and outlet 22. A plurality of channels 30 is disposed within the flow path. Each of the channels 30 includes a wall structure 32, such that the channels are configured as multiple distinct openings at the inlet 20 and extend through the main body to the outlet 22. Generally, the main body is arranged and configured with a flow-through structure, where the channels provide a wall structure as a substrate that creates some amount of turbulence for exhaust gases flowing through the pre-catalyst device.

In some embodiments, the main body is structured and arranged so that the channels provide a substrate having a honeycomb-like structure (i.e. FIGS. 2 and 3). Such a honeycomb structure may be similar to that which may be used in a DOC. In other embodiments, the channels are provided with a wall structure that is formed of various metallic foil configurations, such as may be known in the art and/or as produced by Emitec. For example, the wall structure may be any one of a straight foil (straight channel with laminar flow), LS-foil (longitudinal structured), PE-foil (perforated foil), LS-PE foil (longitudinal structured foil with perforations), and TS-foil (transversal structured foil) or combinations of these metallic foil structures. Examples of such structures can be found for instance in *Faster is Better: The Effect of Internal Turbulence on DOC efficiency,* 2006-01-1525, Dawson et al., SAE International 2006, which is herewith incorporated by reference in its entirety. LS-foils are known to be structured as shovels protruding into the flow channels which can transform general laminar flow into turbulent flow. LS-foils have been known to improve mass transfer by increasing turbulence to help increase catalyst efficiency. LS-foils also can reduce thermal mass (improved light off) and reduce the amount of material for the substrate. PE-foils are known to be structured with perforations to allow for cross-flow within the substrate between the channels. PE-foils have been known to improve catalyst efficiency such as by increasing cross-flow, reducing heat capacity, and reducing backpressure. TS-foils are known to be characterized as micro-corrugations in the channel wall structure formed perpendicular to the exhaust gas flow. Such a structure can support development of a radial flow configuration to enhance the mass transfer between the exhaust gas and the channel wall structure.

It will be appreciated that the particular substrate structure and configuration is meant to be non-limiting, and that depending on the particular design goal(s) different structures and configurations may be employed for allowing more or less turbulence in the exhaust gas flow through the pre-catalyst device.

An oxidizing material 28 is disposed on surfaces 34 of the wall structure 32 of the plurality of channels 30. The oxidizing material 28 is configured to oxidize engine exhaust before the engine exhaust reaches the main aftertreatment device 16. The main body is configured to be disposed upstream of the main aftertreatment device 16. As shown, the outlet 22 of the pre-catalyst device 12 is connected to inlet 24 of the main aftertreatment device 16. The outlet 26 of the main aftertreatment device 16 releases the engine exhaust material from the main aftertreatment device 16.

FIG. 1 shows that the pre-catalyst device 12 is disposed or located upstream of the main catalyst or aftertreatment device 16. As shown, the pre-catalyst device 12 also may be closely coupled to an engine 14 at the turbine outlet 18, depending on certain size constraints and desired applications for the pre-catalyst device. In some embodiments, the pre-catalyst device 12 has a length in the range of about 1 to 2 inches from inlet 20 to outlet 22. One of skill in the art will appreciate that the size of the pre-catalyst device may be modified as desired and/or necessary. In some instances, such a smaller size of the pre-catalyst device is desirable to permit access to a variety of locations that cannot otherwise be accessed with larger diesel oxidation catalysts. Generally, the pre-catalyst device provides a sizing that is convenient for being incorporated with or retrofitted to existing aftertreatment systems, without increasing the need for more space to accommodate the pre-catalyst device. As shown, having the pre-catalyst device at least proximate, and even directly connected to the turbo can provide an advantage of increasing the length/diameter ratio of the system. In such a configuration, residence time of the engine exhaust material before reaching the main aftertreatment device can be increased, which can aid in better conversion efficiencies for example NO conversion to $NO_2$. Also, when the pre-catalyst device is located proximate the turbo or directly connected to the turbo outlet, thermal losses can be minimized which helps maintain a generally higher temperature of the exhaust material flowing through the pre-catalyst device and helps the device reach a light-off temperature much faster.

Relative connections between the turbo outlet 18, pre-catalyst device 12, and main aftertreatment device may be accomplished by employing various connecting structures as may be known in the art and that would be suitable for engine exhaust applications. For example, connecting structures such as employed to mount a main aftertreatment device (i.e. DOC or DPF) may be employed and appropriately sized for connecting the pre-catalyst device within the exhaust system. In other embodiments, it will be appreciated that the turbo outlet 18, pre-catalyst device 12, and main aftertreatment device 16 may not be directly connected to each other as shown in FIG. 1. For example, a variety of other conduit and connective structures may be employed as desired and/or necessary to accomplish relative connections among the turbo outlet 18, pre-catalyst device 12, and aftertreatment device 16.

In some instances, the pre-catalyst device 12 is configured to be disposed approximately 2 to 3 inches upstream of the main aftertreatment device 16. By locating the pre-catalyst device 12 approximately 2 to 3 inches upstream of the main catalyst or main aftertreatment device, flow distribution may be improved and turbulence caused by flow through the pre-catalyst device 12 may be increased. Such a configuration can help eliminate the need for a flow diffuser (i.e. star plug) used in recent systems for flow distribution.

Turning to the flow through configuration of the pre-catalyst device 12, a plurality of channels 30 is disposed within the flow path. Each of the channels 30 includes a wall structure 32, such that the channels are configured as multiple distinct openings at the inlet 20 and extend through the main body to the outlet 22. In one embodiment, channels provide a cellular structure (see FIG. 3) so as not to produce a large back pressure impact on the engine exhaust aftertreatment system. As an example, the pre-catalyst device 12 is structured and arranged with a cell or channel density arrangement in the range of about 100-200 channels per square inch (i.e. honeycomb-like structure).

As shown, the oxidizing material 28 is disposed on surfaces 34 of the wall structure 32 of the plurality of channels 30. The oxidizing material 28 is configured to oxidize engine exhaust before it reaches the main aftertreatment device 16. In one embodiment, the oxidizing material 28 is configured as a chemical coating applied on the inlet face of the pre-catalyst device 12. As shown, the inlet face is the surface 34 of the inlet 20 at the end of the pre-catalyst device 12 such as on outer end portions of the inlet's cellular wall structure 32. The chemical coating can be accomplished in a variety of ways and using various materials as may be known in the art.

The chemical coating may be in the form of at least one of a ceramic washcoat or a glass-based coating, included in a chemical solution, or included with any other carrier material suitable for applying the chemical coating. In one embodiment, such a chemical coating includes a material that is at least one selected from the group consisting of a catalytic precious metal, a catalytic precious metal oxide, a non-catalytic precious metal, a catalytic base metal, and a catalytic base metal oxide. In some embodiments, the chemical coating is present in an elevated loading at the inlet face. The meaning of elevated loading is that the inlet face (or end) of the pre-catalyst device includes an increased amount of chemical coating at the end of the substrate relative to an amount of chemical coating that may be employed within the channels or fluid passageways inside the pre-catalyst device.

In some embodiments, the oxidizing material 28 of the chemical coating may include such catalytic precious metals as platinum (Pt) or palladium (Pd)), or such base metals as vanadium (V), or such base metal oxides as vanadium pentoxide or cerium oxide. The oxidizing material 28 may include other compounds such as barium carbonate $BaCO_3$. One of skill in the art will appreciate that such a list of oxidizing materials is meant to be non-limiting, and that other compounds may be employed in the oxidizing material as long as the chemical coating may carry out its oxidizing function.

In some embodiments, the oxidizing material 28 is present in a concentration loading in the range of about 40 to 120 $gm/ft^3$. It will be appreciated that the amount of oxidized material loaded onto the inlet face is meant to be non-limiting and may include various amounts as suitable and/or necessary to achieve the desired effect of preventing and/or eliminating face-plugging on the main aftertreatment device.

Application of the chemical coating can include, for example, on the free walls and edges of the wall structure 32 at the outer end surface of the inlet face of the pre-catalyst device 12. In one embodiment, the chemical coating is directly and deliberately applied on the outer end surfaces of the cellular wall structure at the inlet 20. It further will be appreciated that the disposition of the chemical coating is not limited, where the chemical coating may be disposed on other areas of the pre-catalyst device 12, as long as the chemical coating is applied on at least the inlet face at the end of the pre-catalyst device 12. For example, the chemical coating may be applied inside the flow-through structure of the pre-catalyst device, such as on the wall structure within the channels.

Turning back to FIG. 1, an engine exhaust aftertreatment system 10 includes a main aftertreatment device that is incorporated with any of the above-described principles for a pre-catalyst device. It will be appreciated that the pre-catalyst device as described may be incorporated in various aftertreatment systems and may be used along with a variety of aftertreatment devices, including but not limited to a diesel oxidation catalyst and a diesel particulate filter.

In some instances, the particular arrangement of the pre-catalyst device relative to the main aftertreatment device may increase flow turbulence and flow distribution to further facilitate prevention of face-plugging. For example, a flow through configuration of the pre-catalyst device and a flow through configuration of the main aftertreatment device may be arranged and configured in an offset relationship further described below.

Figure 4:
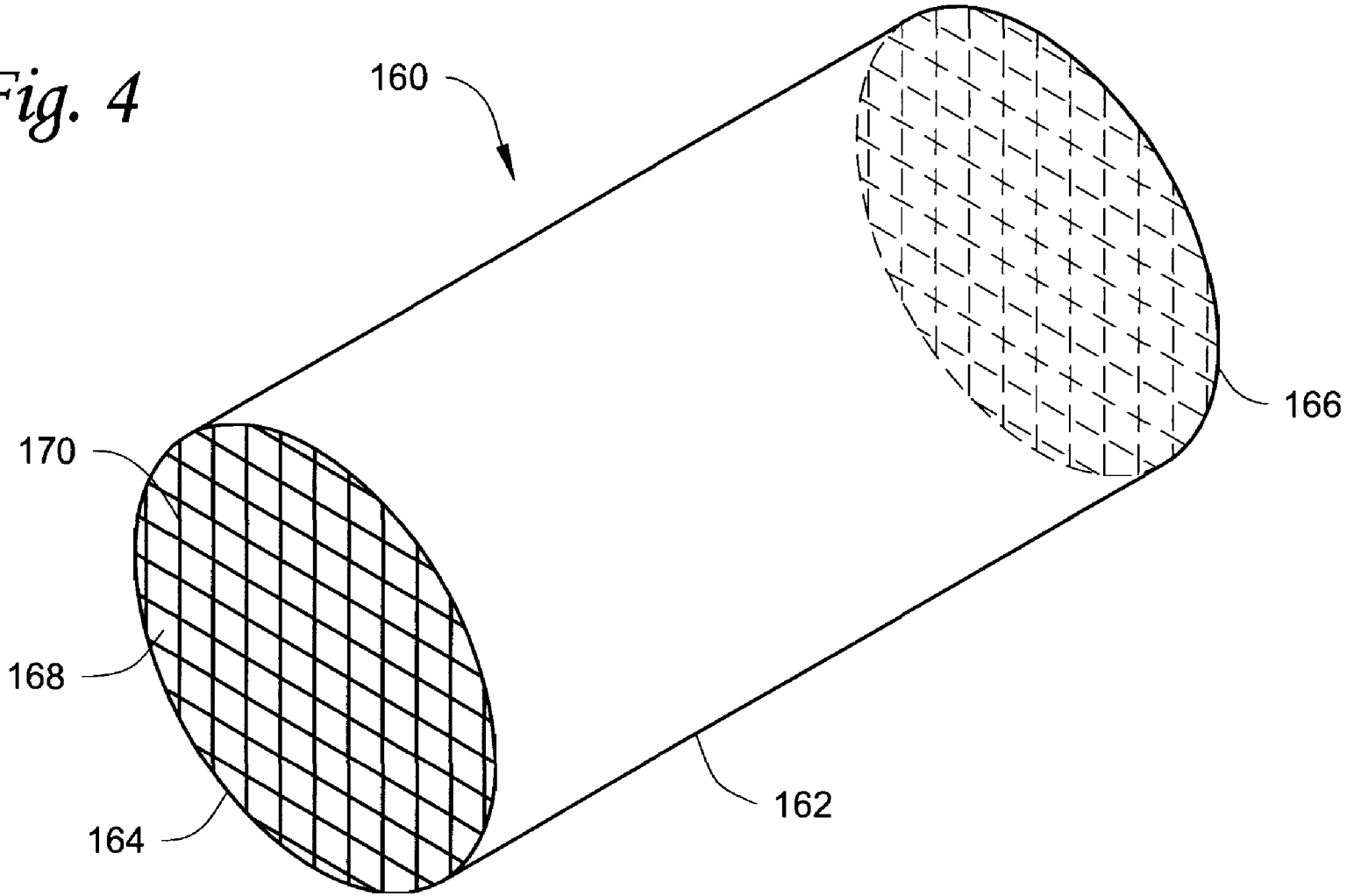
FIG. 4 is a side perspective view of one embodiment of a main aftertreatment device.

FIG. 4 generally illustrates an example of a main aftertreatment device 160. As shown in the example of FIG. 4, the main aftertreatment device is a generally known diesel oxidation catalyst. A main body 162 is configured with a flow through configuration having a flow path (not shown) between an inlet 164 and an outlet 166 (outlet only shown in broken lines), such that engine exhaust may flow through the inlet 164 and outlet 166. Each of the main body, inlet 164, and outlet 166 of the main aftertreatment device 160 is generally cylindrical in nature. The flow path is formed by a plurality of channels 168. Similar to the pre-catalyst device, each of the channels 168 includes a wall structure 170, such that the channels 168 are configured as multiple distinct openings at the inlet 164 and extend through the main body to the outlet 166. Generally, the main body 162 is arranged and configured with a flow-through structure, where the channels provide a wall structure as a substrate that creates some amount of turbulence for exhaust gases flowing through the main aftertreatment device.

In some embodiments, the main body is structured and arranged so that the channels provide a substrate having a honeycomb-like structure. In other embodiments, the channels are provided with a wall structure that is formed of various metallic foil configurations as described above, such as may be known in the art and/or as produced by Emitec. It will be appreciated that the particular substrate structure and configuration is meant to be non-limiting, and that depending on the particular design goal(s) different structures and configurations may be employed for allowing more or less turbulence in the exhaust gas flow through the pre-catalyst device.

The main aftertreatment device 160, which may be any of a diesel oxidation catalyst or diesel particulate filter includes its own flow-through configuration. The main aftertreatment device is configured with a flow path between an inlet and outlet such that engine exhaust may flow through the main aftertreatment device between the inlet and outlet. As described, the main aftertreatment device includes a plurality of flow channels disposed within the flow path. Each of the flow channels includes a wall structure, such that the plurality of channels is configured as multiple distinct openings at the inlet of the main aftertreatment device and extends through the outlet of the main aftertreatment device.

In some embodiments, flow turbulence may be increased by arranging the channels of the main aftertreatment device and the channels of the pre-catalyst device in an offset configuration. For example, the channels 30 of the pre-catalyst device 12 (FIG. 3) may be disposed or rotated out of phase relative to the channels 168 of the main aftertreatment device 160 (i.e. DOC) (see FIG. 4), to increase flow turbulence and improve flow distribution. Generally, the offset configuration is meant where the channels of the pre-catalyst device and the aftertreatment device are not aligned to further disrupt the exhaust gas flow, but where exhaust gas is permitted to flow through the aftertreatment or exhaust system.

In operation, the incorporation of a pre-catalyst device into an engine exhaust aftertreatment system can provide an improved method of preventing face-plugging on a main aftertreatment device. Engine exhaust is first received at the pre-catalyst device. The engine exhaust is oxidized with an oxidizing material disposed on the pre-catalyst device. The oxidized engine exhaust is delivered from the pre-catalyst device downstream to the main aftertreatment device. Face-plugging of an inlet face of the main aftertreatment device is prevented or at least minimized by cleaning the inlet face of the main aftertreatment device with the oxidized engine exhaust flowing from the pre-catalyst device to the main aftertreatment device. For example, face-plugging can be prevented or minimized by the increased NO conversions (i.e. to $NO_2$) across the pre-catalyst device, which allows for more NO oxidation at the main aftertreatment device (i.e. the inlet face of a DOC). As a result, higher hydrocarbon (HC) conversions across the pre-catalyst improve overall HC conversions of an aftertreatment system which means less HC slip.

The pre-catalyst device can prevent or at least minimize inlet face plugging on the aftertreatment device and can help to raise or maintain a higher temperature of the engine exhaust before reaching the aftertreatment device. A higher temperature at the main aftertreatment device and an increased availability of $NO_2$ both can contribute to preventing or minimizing face-plugging. The pre-catalyst device provides a configuration for an engine exhaust aftertreatment system that can increase catalyst volume without increasing the size of the muffler kit. The pre-catalyst device can minimize fuel used during a regeneration by providing more catalyst volume to more efficiently oxidize dosed fuel, and also by enabling higher regeneration temperatures, which can shorten regeneration durations thereby using less regeneration fuel. The pre-catalyst device can improve regeneration robustness in marginal duty cycles. For example, by locating the pre-catalyst device as close to the engine (i.e. turbine outlet) as possible, heat loss on the pipe before the pre-catalyst can be minimized. The pre-catalyst device also can act as a mixing unit to enhance dosed fuel vaporization, where the various substrate wall structures that may be employed for the pre-catalyst device create turbulence of the dosed fuel. Such substrate wall structures help facilitate hydrocarbon conversion efficiency and can allow for 'communication' between the channels for better flow and temperature distribution.

Presence of a pre-catalyst device may also help in initial hydrocarbon conversion and take away some of the burden of the main aftertreatment device, thereby causing a more effective hydrocarbon (HC) conversion and less HC slips past the aftertreatment system. As a result, thermal stress on the main aftertreatment device can be decreased, thereby increasing operation life of the main aftertreatment device. For example, hydrocarbon slip past a diesel particulate filter can be decreased with the pre-catalyst device described above, as compared to an aftertreatment system without the pre-catalyst catalyst device in place.

Experimental Validation:

A pre-catalyst device (approximately 5 inches in length, 7 inches in diameter and 4 inches in width) was experimentally evaluated in a test cell to access the impact on face plugging. The catalyst was loaded to approximately 72 gm/ft$^3$ with the precious metal platinum. The pre-catalyst was constructed of a metallic substrate having approximately 300 cells per square inch. The pre-catalyst was closed coupled to the turbine outlet along with an upstream external fuel doser.

Extended dosing tests were performed with an intent to faceplug a diesel oxidation catalyst (DOC) of an aftertreatment system. A comparison between an aftertreatment system with the pre-catalyst device and an aftertreatment system without the pre-catalyst device was performed under a steady state dosing condition for approximately 12 hours. The aftertreatment system, which did not have the pre-catalyst device, exhibited face plugging on the DOC which was confirmed visually and also shown by an increase in back pressure. The test of the aftertreatment system having the pre-catalyst device did not show any evidence of face plugging on the DOC or on the pre-catalyst device.

The NO to $NO_2$ conversion is a known and documented reaction mechanism. Generally, the function of the platinum on the pre-catalyst helps oxidize NO to $NO_2$ for instance in the temperature range of approximately 275° C. to 400° C., and with peak $NO_x$ conversion at approximately 340° C. Without the pre-catalyst device, NO to $NO_2$ conversion would have to occur across the DOC in order for $NO_2$ to be available at the inlet of the DPF. With the pre-catalyst device, NO to $NO_2$ conversion reactions occur upstream from the DOC, and hence more $NO_2$ is available at the inlet of the DOC to help prevent face plugging. For example, as much as about 50% conversion of NO to $NO_2$ occurs with the pre-catalyst device than without the pre-catalyst (i.e. at least 90% NO remains unconverted prior to reaching the DOC).

The pre-catalyst device, along with the NO conversion to $NO_2$, had an additional benefit of breaking up the dosing fuel into much finer particles and also creating additional turbulence that helped keep the DOC inlet face clean.

The experimental results also confirmed that the hydrocarbon (HC) slip past the diesel particulate filter (DPF) was significantly lower in the aftertreatment system having the pre-catalyst device as compared to a test run of the aftertreatment system without the pre-catalyst device.

The inventive concepts described herein are particularly useful for preventing or at least minimizing inlet face-plugging which may be exhibited by aftertreatment devices in vehicular engines. It will be appreciated, however, that the inventive concepts described herein may be employed in other engines, such as industrial engines. Generally, the pre-catalyst device and its features may be useful for any exhaust or aftertreatment system that may see face plugging issues, or that may include a diesel oxidation catalyst and diesel particulate filter.

The invention may be embodied in other forms without departing from the spirit or novel characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. A pre-catalyst device, for use in a diesel engine exhaust system, comprising:

a housing having an inlet and an outlet, the housing configured with a flow path between the inlet and outlet such that engine exhaust may flow through the inlet and outlet;

a plurality of channels disposed within the flow path, each of the channels including a wall structure such that the plurality of channels configured as multiple distinct openings at the inlet and extending through the housing to the outlet, the housing configured to be disposed upstream of a diesel main aftertreatment device of an engine exhaust system; and an oxidizing material disposed on surfaces of the wall structure of the plurality of channels, the oxidizing material configured to oxidize engine exhaust before the engine exhaust reaches the diesel main aftertreatment device of the engine exhaust system, wherein the housing of the pre-catalyst device is configured to be separate and distinct from a housing of the diesel main aftertreatment device.

2. The pre-catalyst device, for use in a diesel engine exhaust system, of claim 1, wherein the housing of the pre-catalyst device is one of a ceramic material or a metallic material.

3. The pre-catalyst device, for use in a diesel engine exhaust system, of claim 1, wherein the housing of the pre-catalyst device comprises a length in the range of about 1 to 2 inches from inlet to outlet.

4. The pre-catalyst device, for use in a diesel engine exhaust system, of claim 1, wherein the plurality of channels within the flow path of the housing of the pre-catalyst device having a density arrangement in the range of about 100 to 200 channels per square inch.

5. The pre-catalyst device, for use in a diesel engine exhaust system, of claim 1, wherein the oxidizing material comprising at least one precious metal or base metal oxide material.

6. The pre-catalyst device, for use in a diesel engine exhaust system, of claim 1, wherein the oxidizing material including platinum.

7. The pre-catalyst device, for use in a diesel engine exhaust system, of claim 1, wherein the oxidizing material is configured as a coating on the surfaces of the wall structure of the channels, the oxidizing material being present in a concentration loading in the range of about 40 to 120 $gm/ft^3$.

8. The pre-catalyst device, for use in a diesel engine exhaust system, of claim 1, wherein the housing of the pre-catalyst device configured to be disposed approximately 2 to 3 inches upstream of the diesel main aftertreatment device of the engine exhaust system.

9. A diesel engine exhaust aftertreatment system comprising:

a diesel main aftertreatment device, the diesel main aftertreatment device including a housing, an inlet and an outlet, the diesel main aftertreatment device configured with a flow path between the inlet and outlet such that engine exhaust may flow through the housing of the diesel main aftertreatment device between the inlet and outlet of the diesel main aftertreatment device;

a pre-catalyst device disposed upstream of the diesel main aftertreatment device inlet, the pre-catalyst device including a flow path within a housing of the pre-catalyst device, an inlet and outlet, such that engine exhaust may flow through the housing of the pre-catalyst device between the inlet and outlet of the pre-catalyst device;

the pre-catalyst device including a plurality of channels disposed within the flow path, each of the channels including a wall structure such that the plurality of channels configured as multiple distinct openings at the inlet of the pre-catalyst device and extending through the outlet of the pre-catalyst device; and an oxidizing material disposed on surfaces of the wall structure of the plurality of channels, the oxidizing material configured to oxidize engine exhaust before the engine exhaust reaches the diesel main aftertreatment device, wherein the housing of the pre-catalyst device is separate and distinct from the housing of the diesel main aftertreatment device.

10. The diesel engine exhaust aftertreatment system of claim 9, wherein the diesel main aftertreatment device is a diesel oxidation catalyst.

11. The diesel engine exhaust aftertreatment system of claim 9, wherein the plurality of channels within the flow path of the pre-catalyst device having a density arrangement in the range of about 100 to 200 channels per square inch.

12. The diesel engine exhaust aftertreatment system of claim 9, wherein the oxidizing material comprising at least one precious metal or base metal oxide material.

13. The diesel engine exhaust aftertreatment system of claim 9, wherein the oxidizing material is configured as a coating on the surfaces of the wall structure of the channels, the oxidizing material being present in a concentration loading in the range of about 40 to 120 $gm/ft^3$.

14. The diesel engine exhaust aftertreatment system of claim 9, wherein the pre-catalyst device is configured to be disposed approximately 2 to 3 inches upstream of the diesel main aftertreatment device.

15. The diesel engine exhaust aftertreatment system of claim 9, wherein the diesel main aftertreatment device includes a plurality of channels disposed within the flow path of the diesel main aftertreatment device, each of the channels including a wall structure such that the plurality of channels configured as multiple distinct openings at the inlet of the diesel main aftertreatment device and extending through the outlet of the diesel main aftertreatment device, openings of the diesel main aftertreatment device and the openings of the pre-catalyst device being arranged in an offset configuration.

16. The diesel engine exhaust aftertreatment system of claim 9, wherein the pre-catalyst device configured to be connected directly to a turbine outlet of an engine.

17. A method of preventing face-plugging on a diesel main aftertreatment device for a diesel engine exhaust system comprising:

receiving engine exhaust at a pre-catalyst device;

oxidizing the engine exhaust with an oxidizing material disposed on the pre-catalyst device;

delivering oxidized engine exhaust from the pre-catalyst device downstream to the diesel main aftertreatment device; and preventing face plugging of an inlet face of the diesel main aftertreatment device, preventing face plugging including cleaning the inlet face of the diesel main aftertreatment device with the oxidized engine exhaust flowing from a housing of the pre-catalyst device to a separate and distinct housing of the diesel main aftertreatment device.

18. The method of preventing face plugging according to claim 17, further comprising generating flow turbulence and increasing flow distribution of the engine exhaust by offsetting flow through configurations of the pre-catalyst device and the diesel main aftertreatment device.

19. The diesel engine exhaust aftertreatment system of claim 9, wherein the diesel main aftertreatment device is a diesel particulate filter.

20. The pre-catalyst device, for use in a diesel engine exhaust system, of claim 1, wherein the pre-catalyst device is configured to be located proximate a turbine outlet of an engine.

21. The pre-catalyst device, for use in a diesel engine exhaust system, of claim 1, wherein the pre-catalyst device is configured to be connected directly to a turbine outlet of an engine.

22. The diesel engine exhaust aftertreatment system of claim 9, wherein the pre-catalyst device is configured to be located proximate a turbine outlet of an engine.

23. The pre-catalyst device, for use in a diesel engine exhaust system, of claim 1, wherein the oxidizing material is configured to convert NO present in the exhaust gas to $NO_2$.

24. The diesel engine exhaust aftertreatment system of claim 9, wherein the oxidizing material is configured to convert NO present in the exhaust gas to $NO_2$.

25. The method of preventing face plugging according to claim 17, wherein oxidizing the engine exhaust with the oxidizing material disposed on the pre-catalyst device includes converting NO present in the exhaust gas to $NO_2$.

* * * * *